US006648731B2

(12) United States Patent
Shin

(10) Patent No.: US 6,648,731 B2
(45) Date of Patent: Nov. 18, 2003

(54) POLISHING PAD CONDITIONING APPARATUS IN CHEMICAL MECHANICAL POLISHING APPARATUS

(75) Inventor: Sang-hoon Shin, Busan (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 77 days.

(21) Appl. No.: 09/851,336

(22) Filed: May 9, 2001

(65) Prior Publication Data

US 2001/0041520 A1 Nov. 15, 2001

(30) Foreign Application Priority Data

May 9, 2000 (KR) ..... 2000-24615

(51) Int. Cl.[7] ..... B24B 1/00

(52) U.S. Cl. ..... 451/24; 451/41; 451/56; 451/285; 451/287; 451/288; 451/443; 451/444

(58) Field of Search ..... 451/21, 41, 56, 451/285, 287, 288, 443, 444

(56) References Cited

U.S. PATENT DOCUMENTS 5,486,131 A * 1/1996 Cesna et al. ..... 451/56
5,916,010 A * 6/1999 Varian et al. ..... 451/38
6,273,797 B1 * 8/2001 Becker et al. ..... 451/56

FOREIGN PATENT DOCUMENTS

KR 10-0224724 7/1999

* cited by examiner

*Primary Examiner*—Lee D. Wilson
*Assistant Examiner*—Shantese McDonald
(74) *Attorney, Agent, or Firm*—Lee & Sterba, P.C.

(57) ABSTRACT

A polishing pad conditioning apparatus in a chemical mechanical polishing apparatus, wherein the conditioning apparatus includes a conditioning plate which maintains a predetermined relative velocity with respect to the polishing pad, extends from a center region near a rotation center of the polishing pad to a peripheral region near an edge of the polishing pad, and has a polishing portion with polishing particles embedded into its bottom surface, a force generating portion for applying a force to the conditioning plate so that the conditioning plate presses against the polishing pad with pressure that varies according to position on the polishing pad, and conditions the polishing pad by relative linear velocity and pressure with respect to the polishing pad, and a supporting portion for supporting the force generating portion. Therefore, fast and uniform conditioning of a polishing pad can be achieved.

16 Claims, 7 Drawing Sheets

POLISHING PAD CONDITIONING APPARATUS IN CHEMICAL MECHANICAL POLISHING APPARATUS

BACKGROUND OF THE INVENTION

1. Field of the Invention

The present invention relates to a polishing pad conditioning apparatus in a chemical mechanical polishing (CMP) apparatus. More particularly, the present invention relates to a polishing pad conditioning apparatus in a CMP apparatus configured to reduce abnormal wear (abrasion) of the polishing pad.

2. Description of the Related Art

A highly integrated semiconductor device has a multilayered stack structure. Accordingly, it is necessary to perform a polishing process for planarization of each layer formed on a semiconductor wafer in the manufacture of a semiconductor device. A chemical mechanical polishing (CMP) process is a generally accepted polishing technique. The CMP process provides excellent planarity in planarization of both narrow and wide areas, and is advantageously applied to larger wafers.

In the CMP process, the wafer surface, coated with tungsten or oxide, is polished by both mechanical friction and a chemical slurry, thereby achieving a high degree of polishing. Mechanical polishing is used to polish the wafer surface by abrasion between the polishing pad and abrasive particles in the slurry and the wafer surface. The mechanical polishing is further accomplished by rotating the polishing pad in a state in which a wafer fixed to a polishing head is pressed against the surface of the rotating polishing pad with the abrasive particles interposed therebetween. Chemical polishing is used to polish the wafer surface using a slurry as a chemical slurry supplied between the polishing pad and the wafer.

In the planarization technique using the CMP apparatus, the surface state of the polishing pad of the CMP apparatus is an important factor in determining the characteristics of the wafer surface, such as uniformity, planarity or roughness. In the continuous polishing process, the abrasive or other kinds of foreign matter accumulate on the polishing pad, and the polishing pad may become damaged due to these materials. Consequently, the surface of the polishing pad experiences a change in its surface state, causing deterioration to the planarization stability.

Thus, in order to maintain a stable surface state of a polishing pad in performing a continuous planarization process on a wafer using a CMP apparatus, various kinds of polishing pad conditioners and conditioning methods using the conditioners have been proposed.

A generally known conditioning method of a polishing pad includes abrading the surface of the polishing pad with a conditioner formed by embedding diamond particles in a circular plate made of a nickel and iron alloy and evenly conditioning the entire surface of the polishing pad.

FIG. 1 illustrates a schematic plan view of a conventional CMP apparatus that is most typically used.

Referring to FIG. 1, a disc-shaped polishing pad 1 is mounted on a rotation plate (not shown) and rotates in one direction, and a conditioner 2 is positioned thereon. The conditioner 2 rotates in the same direction as the polishing pad 1 by means of a separate rotation device and is moved across the polishing pad 1 from a portion near its center region to its peripheral region, by means of a rotary arm 3.

The conditioner 2, as shown in FIG. 3, has polishing particles 2*b*, such as diamond particles, embedded into the bottom surface of a metal base 2*a*. The conditioner 2, as shown in FIG. 2, is fixed to the bottom surface of a conditioner head 4. The conditioner head 4 is fixed to the bottom surface of the leading end of the rotary arm 3 and is rotated by a motor 5 mounted thereon.

Since the conventional CMP apparatus is configured to polish the polishing pad 1 by means of the rotating conditioner 2 which moves across the surface of the polishing pad 1 by the rotary arm 3, a nonuniform surface may result from a difference in the amount of material polished (also termed wear amount or removal rate) according to position, as illustrated in FIG. 4. That is to say, since the innermost and outermost parts of the polishing pad 1 are not ranged over by the conditioner 2, conditioning is insufficiently performed at those parts. On the other hand, the center region of the polishing pad 1 is fully ranged over by the conditioner 2, thereby producing sloping portions. As a result, the conditioned area of the pad is reduced across the whole polishing pad 1, which can be explained by the following empirical relationship known as Preston's equation:

$$\text{Removal rate} \propto \text{Linear velocity} \times \text{Pressure} \quad (1)$$

Equation (1) indicates that the wear amount is proportional to the product of the pressure and the relative linear velocity between wafer and pad, at a given position on the pad, for constant operation time.

According to equation (1), as shown in FIG. 5, a difference in the amount of polished pad material is exhibited between the center region and peripheral region of the polishing pad, which is because the linear velocity decreases toward rotation center region of the polishing pad and increases toward the peripheral region thereof.

Korean Patent Application 96-59185 discloses a technique in which a conditioner for polishing a polishing pad is configured to have polishing particles distributed at different densities with respect to position on the polishing pad. This technique is intended to decrease the wear rate at the center of the range covered by conditioner to thus eliminate the sloping portions due to incomplete polishing at the center and peripheral regions of the polishing pad, as shown in FIG. 4. However, while conditioning according to this technique partially solves the problem of incomplete polishing, it cannot solve the problem of nonuniform polishing due to a difference in the relative linear velocity.

SUMMARY OF THE INVENTION

To solve the above problems, it is a feature of an embodiment of the present invention to provide a polishing pad conditioning apparatus in a chemical mechanical polishing apparatus, by which uniform conditioning can be achieved across the polishing pad by reducing a local difference in the amount of polishing pad material removed during conditioning depending on a difference in the linear velocity of the polishing pad.

It is a second feature of an embodiment of the present invention to provide a polishing pad conditioning apparatus in a chemical mechanical polishing apparatus, by which the effective conditioned area on the polishing pad is extended.

It is a third feature of an embodiment of the present invention to provide a polishing pad conditioning apparatus in a chemical mechanical polishing apparatus configured to simultaneously perform a CMP process for a wafer and a conditioning process for the polishing pad.

Accordingly, to provide for the first feature, there is provided a polishing pad conditioning apparatus including a conditioning plate which maintains a predetermined relative velocity with respect to the polishing pad, extends from a center region near a rotation center of the polishing pad to a peripheral region near an edge of the polishing pad, and has a polishing portion with polishing particles embedded into its bottom surface, a force generating portion for applying a force to the conditioning plate so that the conditioning plate presses against the polishing pad with pressure that varies according to position on the polishing pad, and conditions the polishing pad by relative linear velocity and pressure with respect to the polishing pad, and a supporting portion for supporting the force generating portion.

Preferably, the force generating portion is configured to apply a force to the conditioning plate so that the conditioning plate presses against the polishing pad with a pressure decreasing linearly or non-linearly across the polishing pad from its center region to its peripheral region.

The polishing portion is preferably semicircular-cylindrically shaped.

The force generating portion may include a housing enclosing a compressed air chamber and having a compressed air injecting portion at its one side, and an expanding portion provided in the lower opening portion of the housing, and having a membrane deformed by the pressure inside the housing to press the conditioning plate and a frame for supporting the membrane. A slot, which permits deformation of the membrane, is preferably provided in the frame of the expanding portion. In particular, the width of the slot formed in the frame of the expanding portion preferably decreases, linearly or non-linearly, from the center region to the peripheral region of the polishing pad In the chemical mechanical polishing apparatus according to an embodiment of the present invention, the supporting portion preferably supports the force generating portion at its one end, and its opposite end is preferably a load portion rotatably fixed to the platform positioned at one side of the rotation plate.

These and other features of the present invention will readily apparent to those of ordinary skill in the art upon review of the detailed description that follows.

BRIEF DESCRIPTION OF THE DRAWINGS

The above features and advantages of the present invention will become more apparent by describing in detail a preferred embodiment thereof with reference to the attached drawings in which.

DETAILED DESCRIPTION OF THE PREFERRED EMBODIMENTS

Korean Patent Application No. 00-24615, filed on May 9, 2000, and entitled: "Polishing Pad Conditioning Apparatus in Chemical Mechanical Polishing Apparatus," is incorporated by reference herein in its entirety.

A CMP apparatus according to a preferred embodiment of the present invention will now be described in detail with reference to the accompanying drawings.

Figure 1:
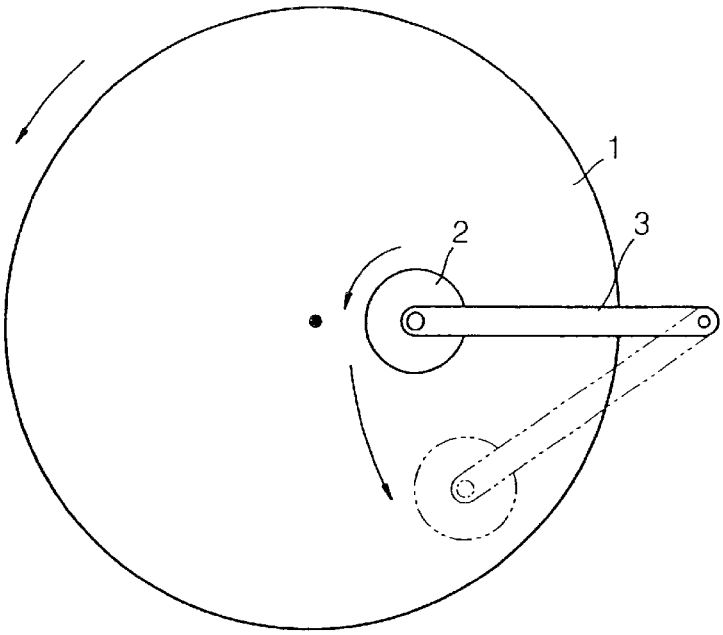
FIG. 1 (PRIOR ART)
FIG. 1 illustrates a schematic plan view of a conventional chemical mechanical polishing (CMP) apparatus known in the prior art.
Figure 2:
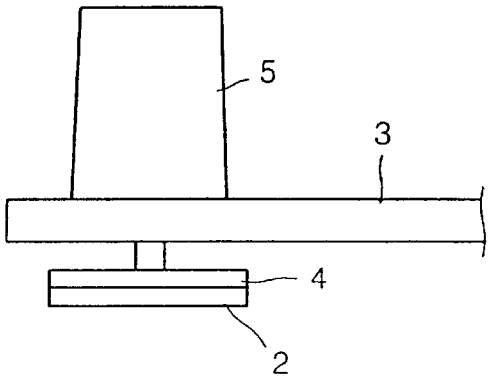
FIG. 2 (PRIOR ART)
FIG. 2 illustrates a side view of a polishing pad conditioning apparatus employed in the conventional CMP apparatus shown in FIG. 1.
Figure 3:
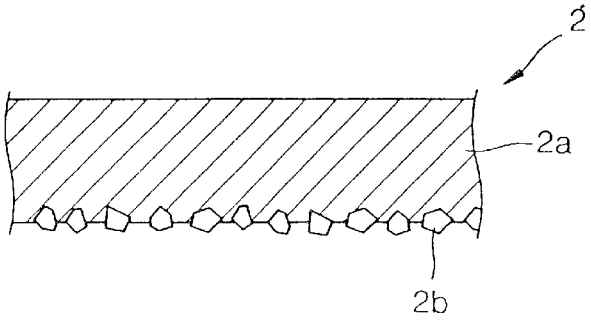
FIG. 3 (PRIOR ART)
FIG. 3 illustrates an extracted cross-sectional view of a conditioner in the conventional conditioning apparatus shown in FIG. 2.
Figure 4:
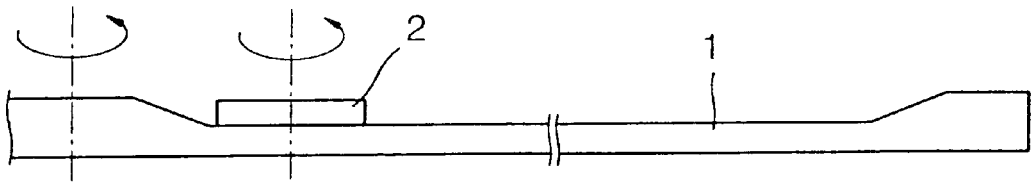
FIG. 4 (PRIOR ART)
FIG. 4 illustrates a schematic cross-sectional view of an unevenly conditioned polishing pad in the conventional conditioning apparatus shown in FIG. 2.
Figure 5:
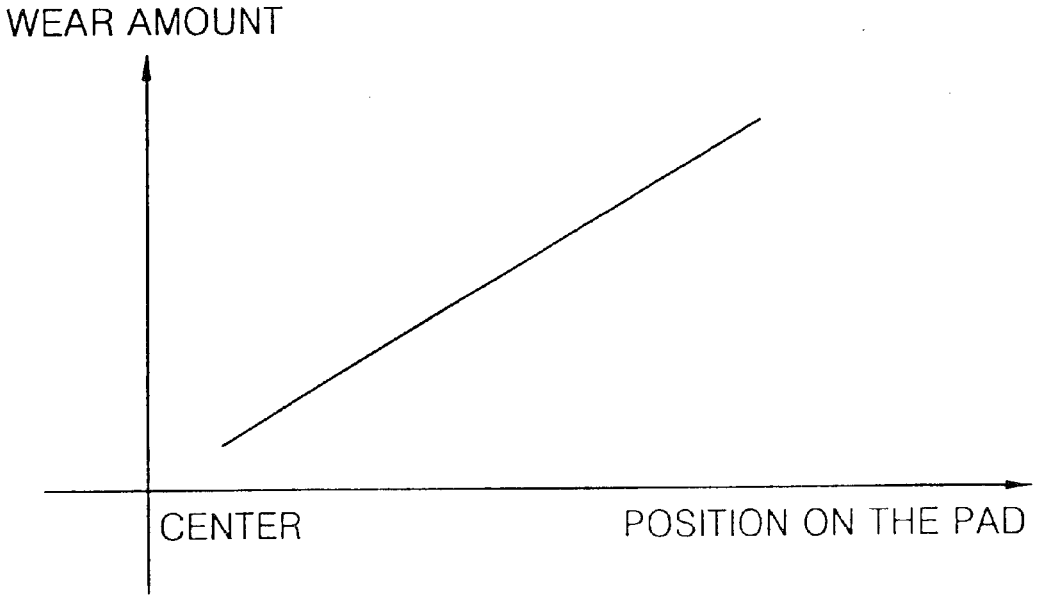
FIG. 5 (PRIOR ART)
FIG. 5 graphically depicts a difference in the amount of polishing pad material removed by the conventional conditioning apparatus shown in FIG. 2, depending on a difference in linear velocity with position on the polishing pad.
Figure 6:
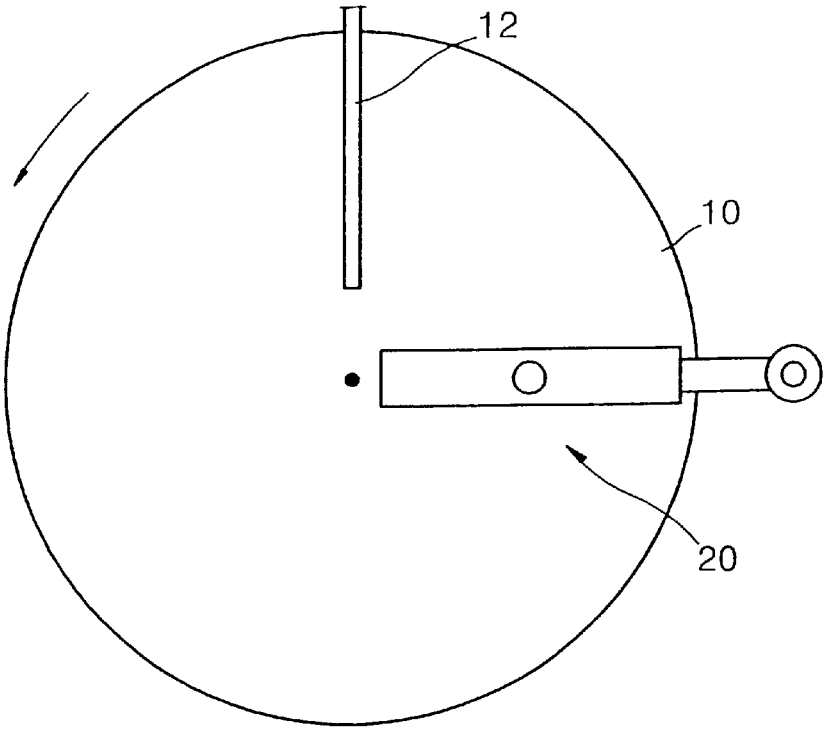
FIG. 6 illustrates a schematic plan view of a CMP apparatus according to a preferred embodiment of the present invention.
Figure 7:
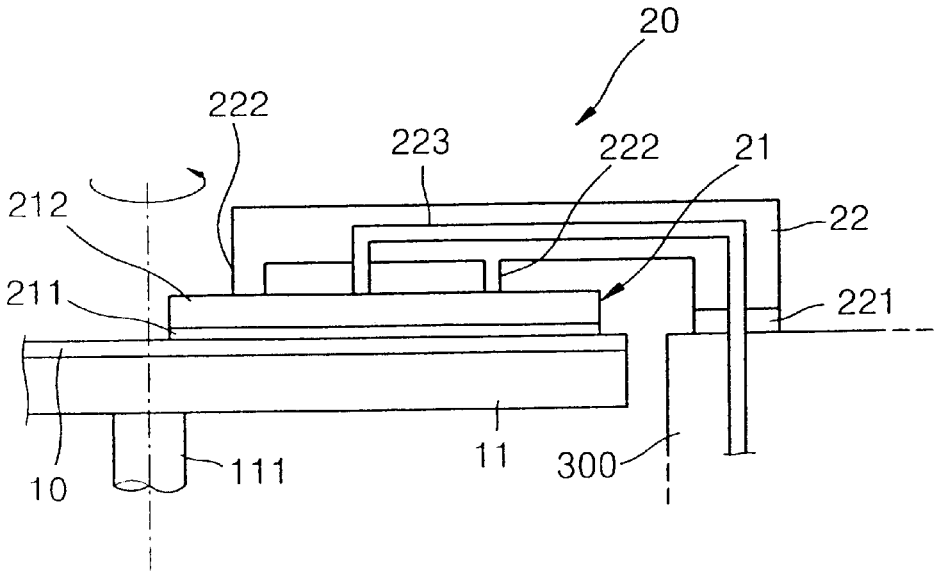
FIG. 7 illustrates a schematic side view of the CMP apparatus shown in FIG. 6.

FIGS. 6 and 7 illustrate a polishing pad conditioning apparatus in a CMP apparatus according to a preferred embodiment of the present invention, in which FIG. 6 illustrates a plan view showing the arrangement of the polishing pad and the conditioning apparatus, and FIG. 7 illustrates a side view thereof.

Referring to FIGS. 6 and 7, a polishing pad 10 is fixed to a rotation plate 11 rotating about a rotation axis 111. An abrasive supplying portion 12 for supplying slurry to the surface of the polishing pad 10 is positioned over one side of the polishing pad 10. A pad conditioning apparatus 20 extends from the center region near the rotation center of the polishing pad 10 to the peripheral region near the edge thereof. The conditioning apparatus 20 conditions the polishing pad 10 while remaining in a fixed position and continuously contacting the polishing pad 10 from its center region to its peripheral region. Here, the center region refers to the rotation center of the polishing pad 10 and the inner part of the polishing pad 10 within a relatively short radius of the rotation center, and the peripheral region refers to the edge parts of the polishing pad 10 and the outer part of the polishing pad 10 near the edge parts. The polishing pad conditioning apparatus 20 includes a head portion 21 and a load portion 22. The head portion 21 includes a conditioning plate 211 in contact with the polishing pad 10, and a force generating portion 212 for applying force to the conditioning plate 211 so as to allow the conditioning plate 211 to contact the polishing pad 10 with a pressure gradually decreasing across the polishing pad 10 from its center region to its peripheral region, specifically, the pressure linearly decreases. The load portion 22 supports the head 21 by means of a support portion 222, and includes a compressed air supply line 223 extending from the inside of a rotation support portion 221 fixed to a platform 300, to the head portion 21. The load portion 22, which maintains the contact state of the conditioning plate 211 by means of the force generating portion 212, is fixed to the platform 300 provided next to the rotation plate 11, at its rear end. Preferably, the load portion 22 is fixed with respect to the platform 300 by means of the rotation support 221 so that the head portion 21 can be disengaged from the polishing pad 211.

The force generating portion 212 may apply force to the conditioning plate 211 such that the conditioning plate 211 presses against the polishing pad 10 with a pressure diminishing across the polishing pad 20 from its center region to its peripheral region. On the other hand, the conditioning plate 211 may press against the polishing pad 10 with pressure varying in some other manner with position on the polishing pad 10, that is, the pressure applied to the conditioning plate 211 may increase or decrease linearly, or may vary non-linearly across the polishing pad from the center region to the peripheral region, not being limited to the non-linear decreasing case.

In other words, the technical gist of the present invention lies in that force corresponding to conditioning pressure is discriminately applied to various parts of the conditioning plate 211 according to the position on the polishing pad 10.

Thus far, it has been described that while the conditioning plate 211 is in continuous contact with the polishing pad 10 from its center region to its peripheral region by the force generating portion 212, the conditioning plate 211 presses against the polishing pad 10 with pressure varying across the polishing pad 10 from its center region to its peripheral region.

Figure 8:
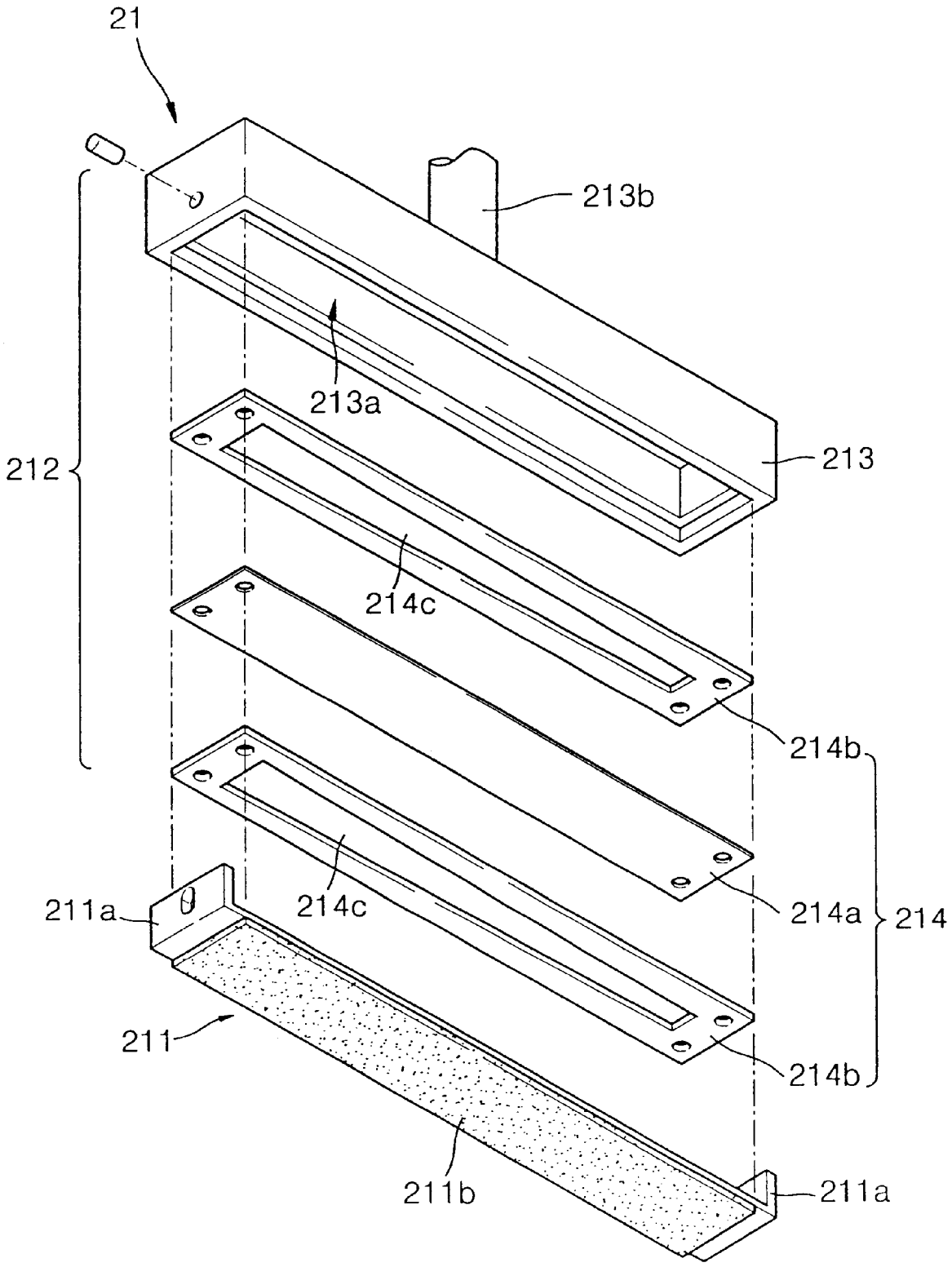
FIG. 8 illustrates a schematic exploded perspective view of a head portion in a conditioning apparatus employed in the CMP apparatus shown in FIG. 6.
Figure 9:
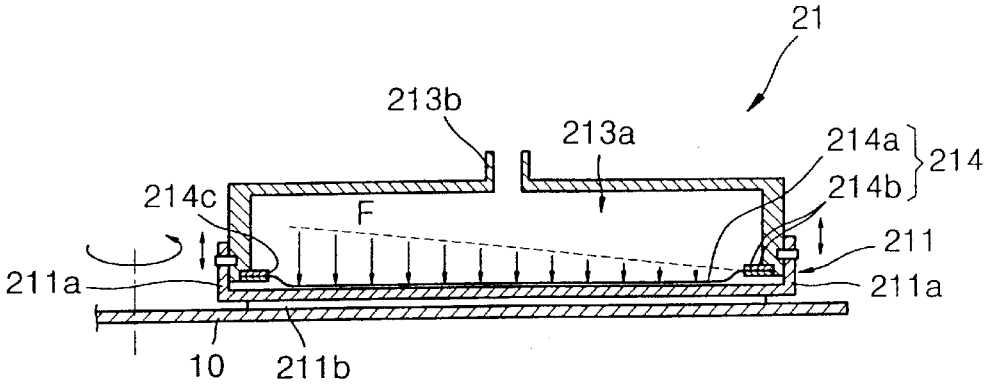
FIG. 9 illustrates a cross-sectional view showing the relationship between the conditioning apparatus of FIG. 8 and a polishing pad pressed thereby.

FIG. 8 illustrates a schematic, exploded, perspective view of the head portion 21, and FIG. 9 illustrates a cross-sectional view thereof.

Referring to FIGS. 8 and 9, the force generating portion 212 of the head portion 21 includes a compressed air injecting portion 213*b* formed on its top portion. A housing 213 having a compressed air chamber 213*a* connected to the compressed air injecting portion 213*b*, and an expanding portion 214 having a membrane 214*a* installed at an opening portion in the lower portion of the housing 213 to be deformed by the internal pressure of the compressed air chamber 213*a* and a frame 214*b* for supporting the membrane 214*a*, are provided in the interior part of the force generating portion 212. The frame 214*b* that supports the membrane 214*a* is fixed to either side of the membrane 214*a* and has a slot 214*c* that allows the membrane 214*a* to be deformed into a predetermined shape. Compressed air is supplied from an external compressed air injecting device (not shown) to the compressed air chamber 213*a* through the compressed air injecting portion 213*b*. The pressure of the compressed air is transferred to the membrane 214*a* and then transferred to the conditioning plate 211, as will be described in detail later, by the deformed membrane 214*a*.

The conditioning plate 211 having a polishing part 211*b* having polishing particles, such as diamond particles, embedded therein, is positioned under the expanding portion 214. Flanges 211*a*, movably coupled to both ends of the housing 213 so as to reciprocate a predetermined distance, are provided at both ends of the conditioning plate 211. The conditioning plate 211 is pressed by the membrane 214*a* of the expanding portion 214 and is coupled so as to be movable up and down with respect to the housing 213 of the head portion 21, so that the distance between the conditioning plate 211 and the housing 213 varies depending on the pressure caused by the membrane 214*a*.

Figure 10:
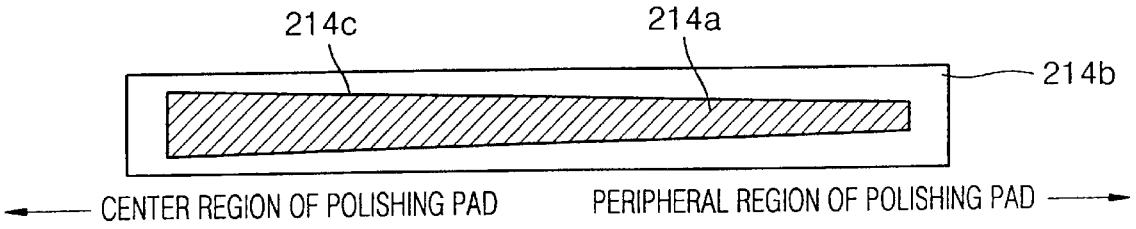
FIG. 10 illustrates a plan view of an expanding portion employed in the conditioning apparatus of FIGS. 8 and 9.
Figure 11:
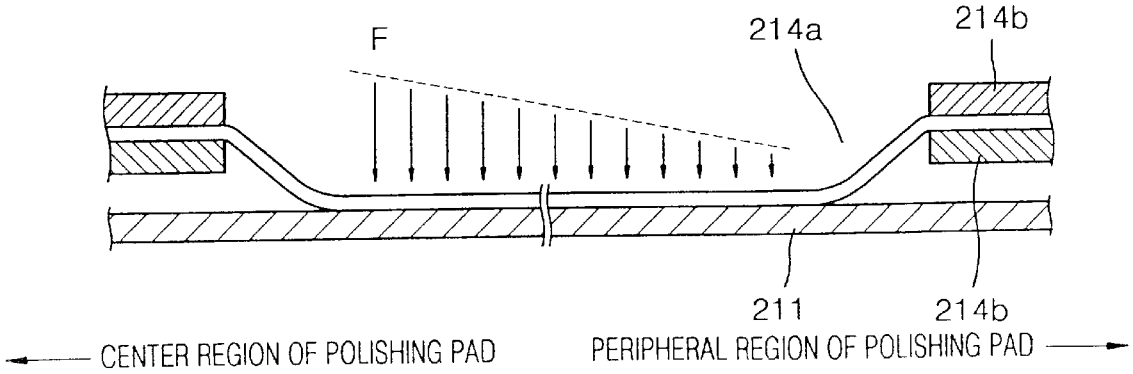
FIG. 11 illustrates a cross-sectional view showing the relationship between the membrane of the conditioning apparatus shown in FIGS. 8 and 9 and a conditioning plate pressed thereby.
Figure 12:
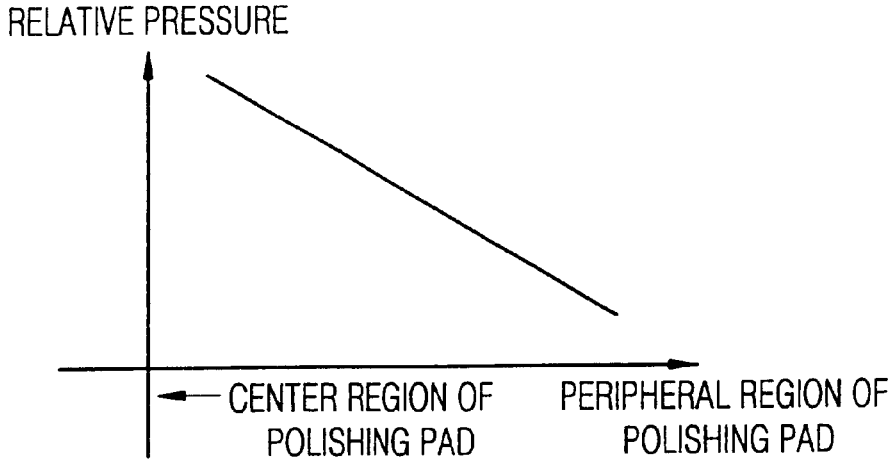
FIG. 12 graphically depicts a change in pressure with position on a polishing pad according to the CMP apparatus according to the present invention.

Referring now to FIG. 10, the frame 214*b* of the expanding portion 214 is configured such that the portion through which the membrane 214*a* is exposed, that is, the slot 214*c* that permits the deformation of the membrane 214*a*, has a band-like shape having a width decreasing from the pad center region to the peripheral region. Thus, as illustrated in FIG. 10, the deformed part of the membrane 214*a* supported by the frame 214*b* is limited by the slot 214*c* of the frame 214*b*. Accordingly, the shape of the area which presses against the conditioning plate 211 also corresponds to that of the slot 214*c*. Thus, the force (F) applied to the conditioning plate 211, as represented by the product of pressure (P) and area (A), that is, $F=P\times A$, varies with position according to the shape of the slot 214*c*, as shown in FIGS. 9 and 11. A change in pressure with position on the polishing pad 10 is illustrated in FIG. 12.

According to the above-described configuration, the pressure at a low relative velocity region, that is, the center region of the polishing pad 10, is made larger, and the pressure at a peripheral region is made smaller. Here, the linear velocity with position on the polishing pad 10 in contact with the conditioning plate 211 increases linearly across the polishing pad 10 from its center region to its peripheral region. Accordingly, it is preferable that the force generated by the force generating portion 212 decreases linearly. Thus, based on Preston's empirical relationship represented by Equation (1), the difference in the wear amount depending on the difference in the linear velocity is compensated for by the pressure difference, thereby uniformly maintaining the wear amount across the polishing pad 10 to be within a predetermined range.

Figure 15:
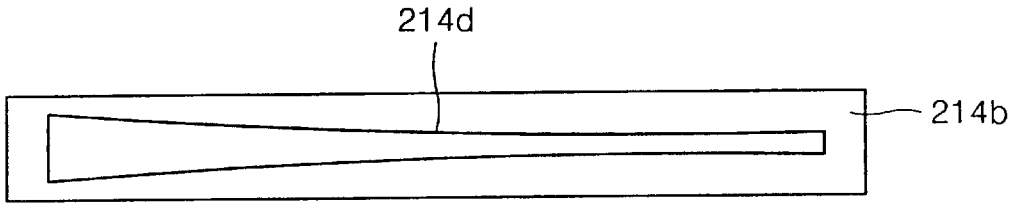
FIG. 15 illustrates a plan view showing another example of a frame of an expanding portion employed in the CMP apparatus according to the present invention.
Figure 16:
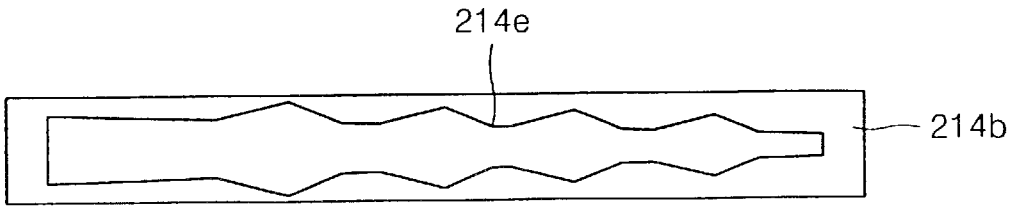
FIG. 16 illustrates a plan view showing still another example of a frame of an expanding portion employed in the CMP apparatus according to the present invention.

In the frame 214*b* of the expanding portion 214, the slot 214*c* may have a shape other than the band-like shape shown in FIG. 10 in which the width thereof gradually decreases from the pad center region to the pad peripheral region. In other words, in the case described as above, the force generating portion 212 applies a force to the conditioning plate 211 such that the conditioning plate 211 presses against the polishing pad 10 with the pressure diminishing across the polishing pad 10 from its center region to its peripheral region. Alternatively, in order to make the conditioning plate 211 press against the polishing pad 10 with pressures different with position on the polishing pad 10, the width of a slot 214*d*, which is shaped as shown in FIG. 15, may decrease non-linearly. Also, as shown in FIG. 16, a slot 214*e* may be configured such that the pressure applied to the polishing pad 10 increases locally on the polishing pad 10 or increases non-linearly across the polishing pad 10 from its center region to its peripheral region.

In the above-described configuration, the conditioning plate 211 incorporates a polishing portion 211*b* embedded with polishing particles. However, in some cases, the polishing portion 211*b* may be separately provided so as to be fixed to the bottom surface of the conditioning plate 211.

Figure 13:
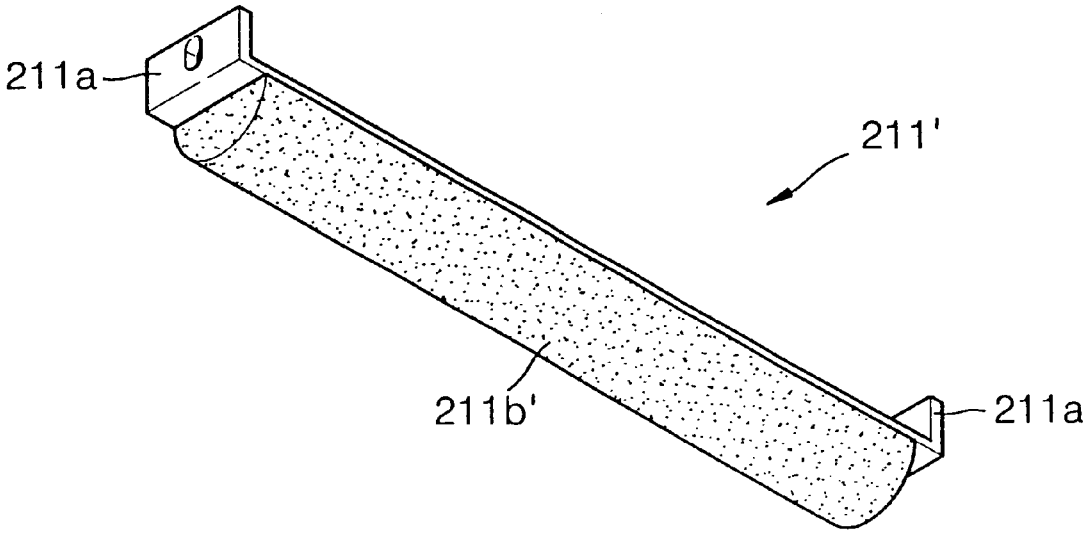
FIG. 13 illustrates a perspective view showing another example of a conditioning plate employed in the CMP apparatus according to the present invention.

In the above-described embodiment, the polishing portion 211*b* of the conditioning plate 122 contacting the polishing pad 10 is planar. In another embodiment of the present invention, as shown in FIG. 13, a polishing portion 211*b*' with a semicircular cross-section may be provided in a conditioning plate 211' so that polishing particles adhere to the surface of the polishing portion 211*b*'.

The above-described conditioning plates 211 and 211' are configured such that they are fixed to both sides of the housing 213 of the head portion 21 by the flanges 211*a*, which is however presented by way of illustration only. The structure of connection between the conditioning plate 211 or 211' and the housing 213 may be changed in various ways so that the position of the conditioning plate 211 or 211' relative to the housing 213 can vary when it is pressed by the membrane 214*a*.

The above-described CMP apparatus according to an embodiment of the present invention can simultaneously perform both wafer polishing and polishing pad conditioning, based on the structural feature of the conditioning apparatus for conditioning the entire area of the polishing pad 10 while remaining in a fixed position.

Figure 14:
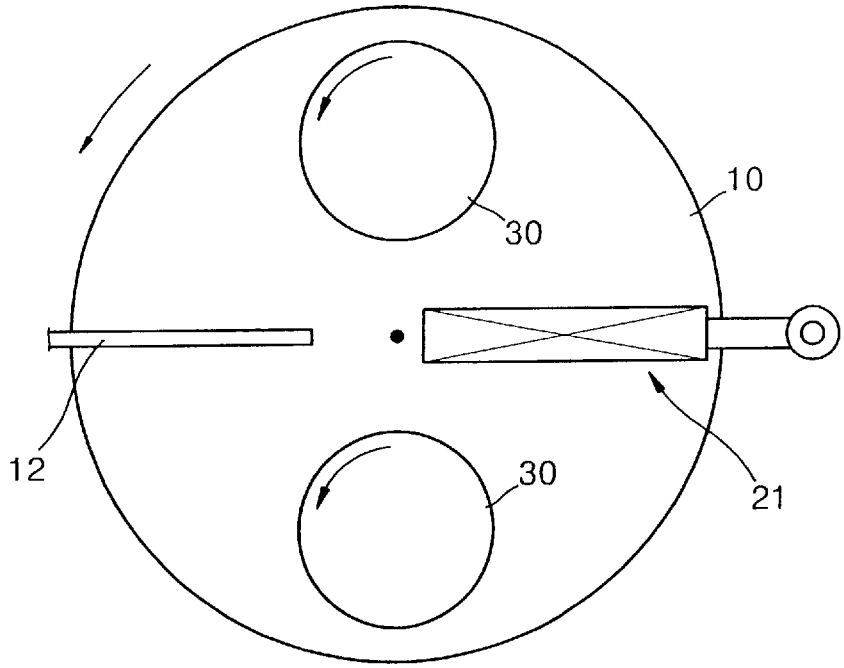
FIG. 14 illustrates a schematic plan view showing how to use the CMP apparatus according to the present invention.

In other words, as illustrated in FIG. 14, for example, while slurry is supplied to the polishing pad 10 rotating counterclockwise through the abrasive supplying portion 12, wafer polishing is performed in a state in which two wafers 30 are brought into contact with the polishing pad 10 at opposite sides about the rotation axis of the polishing pad 10, and the conditioning apparatus 21 is positioned between the wafers 30 to then perform polishing pad conditioning, the present invention being characterized by the conditioning apparatus 21.

As described above, according to an embodiment of the present invention, both wafer polishing and polishing pad conditioning can be simultaneously performed since the apparatus for conditioning the polishing pad has a fixed position and occupies a small area of the polishing pad, unlike in the conventional art. In particular, the conditioning apparatus is configured so as to cover all parts from the center region of the polishing pad to the peripheral region, so that one cycle of conditioning for the overall polishing pad can be performed by one cycle of rotation of the polishing pad, thereby achieving uniform conditioning of the entire polishing pad.

Although the above-described embodiment has shown that the polishing pad rotates, the head may be configured to rotate on the polishing pad in a state in which the position of the polishing pad is fixed, so that the head rotates at a predetermined velocity relative to the polishing pad.

As described above, according to an embodiment of the present invention, fast conditioning of a polishing pad can be achieved, as compared to the conventional CMP apparatus, which performs conditioning of a polishing pad by local polishing. Also, the pressing structure of an embodiment of the present invention can reduce a difference in the wear amount, which occurs due to a difference in linear velocity according to position on the polishing pad. In particular, since the apparatus of the present invention is configured to simultaneously perform wafer polishing and polishing pad conditioning, the operation idle time can be reduced, as compared to that of the conventional apparatus, in which polishing pad conditioning is separately performed.

Therefore, the wear amount can be uniformly maintained across the polishing pad, thereby extending the usable lifetime of the polishing pad. Also, since the polishing pad is maintained at an optimum surface state, a high level uniformity of wafer polishing can be maintained.

The present invention has been described in terms of specific embodiments set forth in detail. It should be understood, however, that these embodiments are presented by way of illustration only, and that the invention is not limited thereto. Modifications and variations within the spirit and scope of the claims that follow will be readily apparent from this disclosure, as those of ordinary skill in the art will appreciate.

What is claimed is:

1. A polishing pad conditioning apparatus in a chemical mechanical polishing apparatus having a polishing pad for performing wafer polishing, and a rotation plate for supporting the polishing pad, the polishing pad conditioning apparatus comprising:

a conditioning plate which maintains a predetermined relative velocity with respect to the polishing pad, extends from a center region near a rotation center of the polishing pad to a peripheral region near an edge of the polishing pad, and has a polishing portion with polishing particles embedded into a bottom surface;

a force generating portion for applying a force to the conditioning plate so that the conditioning plate presses against the polishing pad with pressure that varies according to position on the polishing pad, the pressure decreasing linearly or non-linearly across the polishing pad from its center region to its peripheral region, and the conditioning plate conditions the polishing pad by relative linear velocity and pressure with respect to the polishing pad; and a supporting portion for supporting the force generating portion.

2. The polishing pad conditioning apparatus according to claim 1, wherein the polishing pad is configured to rotate and the conditioning plate has a fixed position.

3. The polishing pad conditioning apparatus according to claim 2, wherein the polishing portion is semicircular-cylindrically shaped.

4. The polishing pad conditioning apparatus according to claim 2, wherein the force generating portion comprises:

a housing enclosing a compressed air chamber and having a compressed air injecting portion at one side, and an expanding portion provided in a lower opening portion of the housing, the expanding portion having a membrane deformed by pressure inside the housing to press the conditioning plate, and a frame for supporting the membrane.

5. The polishing pad conditioning apparatus according to claim 4, wherein a slot which permits deformation of the membrane is provided in the frame of the expanding portion.

6. The polishing pad conditioning apparatus according to claim 5, wherein a width of the slot formed in the frame of the expanding portion decreases linearly or non-linearly from the center region to the peripheral region of the polishing pad.

7. The polishing pad conditioning apparatus according to claim 5, wherein the supporting portion supports the force generating portion at a first end, and a second end is a load portion rotatably fixed to a platform positioned at one side of the rotation plate.

8. The polishing pad conditioning apparatus according to claim 6, wherein the supporting portion supports the force generating portion at a first end, and a second end is a load portion rotatably fixed to a platform positioned at one side of the rotation plate.

9. The polishing pad conditioning apparatus according to claim 2, wherein the supporting portion supports the force generating portion at a first end, and a second end is a load portion rotatably fixed to a platform positioned at one side of the rotation plate.

10. The polishing pad conditioning apparatus according to claim 1, wherein the polishing portion is semicircular-cylindrically shaped.

11. The polishing pad conditioning apparatus according to claim 1, wherein the force generating portion comprises:

a housing enclosing a compressed air chamber and having a compressed air injecting portion at one side, and an expanding portion provided in a lower opening portion of the housing, the expanding portion having a membrane deformed by pressure inside the housing to press the conditioning plate, and a frame for supporting the membrane.

12. The polishing pad conditioning apparatus according to claim 11, wherein a slot which permits deformation of the membrane is provided in the frame of the expanding portion.

13. The polishing pad conditioning apparatus according to claim 12, wherein a width of the slot formed in the frame of the expanding portion decreases linearly or non-linearly from the center region to the peripheral region of the polishing pad.

14. The polishing pad conditioning apparatus according to claim 12, wherein the supporting portion supports the force generating portion at a first end, and a second end is a load portion rotatably fixed to a platform positioned at one side of the rotation plate.

15. The polishing pad conditioning apparatus according to claim 13, wherein the supporting portion supports the force generating portion at a first end, and a second end is a load portion rotatably fixed to a platform positioned at one side of the rotation plate.

16. The polishing pad conditioning apparatus according to claim 1, wherein the supporting portion supports the force generating portion at a first end, and a second end is a load portion rotatably fixed to a platform positioned at one side of the rotation plate.

* * * * *